US007201475B2

(12) United States Patent
Shiho et al.

(10) Patent No.: US 7,201,475 B2
(45) **Date of Patent: *Apr. 10, 2007**

(54) LIQUID SUPPLYING MEMBER, METHOD OF MANUFACTURING THE SAME, AND LIQUID EJECTION APPARATUS INCORPORATING THE SAME

(75) Inventors: Akihiko Shiho, Nagano (JP); Hitotoshi Kimura, Nagano (JP); Hitoshi Matsumoto, Nagano (JP); Toshio Kumagai, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 270 days.

This patent is subject to a terminal disclaimer.

(21) Appl. No.: 10/840,629

(22) Filed: May 7, 2004

(65) Prior Publication Data

US 2005/0024449 A1 Feb. 3, 2005

Related U.S. Application Data

(63) Continuation-in-part of application No. 10/374,526, filed on Feb. 27, 2003, now abandoned.

(30) Foreign Application Priority Data

| | | |
|---|---|---|
| Feb. 28, 2002 | (JP) | P2002-053905 |
| Feb. 3, 2003 | (JP) | P2003-026154 |
| May 9, 2003 | (JP) | P2003-132104 |

(51) Int. Cl.
*B41J 2/175* (2006.01)

(52) U.S. Cl. ..... 347/85

(58) Field of Classification Search ..... 347/37, 347/85, 86

See application file for complete search history.

(56) References Cited

U.S. PATENT DOCUMENTS 4,981,760 A 1/1991 Naito et al.

(Continued)

FOREIGN PATENT DOCUMENTS

| | | |
|---|---|---|
| EP | 1 172 218 A1 | 1/2002 |
| JP | 6-000746 U | 1/1994 |
| JP | 6-198903 A | 7/1994 |
| JP | 7-314719 | 12/1995 |
| JP | 9/300652 | 11/1997 |
| JP | 2001-026119 A | 1/2001 |

OTHER PUBLICATIONS

Patent Abstracts of Japan, Publication No. 2001-212974, Publication Date Jul. 8, 2001, Ink-Jet Type Recording Apparatus and Method for Replenishing Ink to Sub Tank in the Apparatus.

(Continued)

*Primary Examiner*—An H. Do
(74) *Attorney, Agent, or Firm*—Sughrue Mion, PLLC

(57) ABSTRACT

A liquid supplying member supplies liquid from a liquid container to a liquid ejection head which are provided in a liquid ejection apparatus. In the liquid supplying member, a flexible base member has a face formed with at least one groove. A flexible first plate member is joined to the face of the base member so as to seal at least a part of the at least one groove to form at least one liquid supplying passage, through which the liquid is supplied from the liquid container to the liquid ejection head. A first connector is monolithically formed with a longitudinal end portion of the base member to connect the at least one groove to one of the liquid container and the liquid ejection head.

15 Claims, 17 Drawing Sheets

U.S. PATENT DOCUMENTS

| | | | | |
|---|---|---|---|---|
| 5,025,270 | A | | 6/1991 | Umezawa |
| 5,043,746 | A | | 8/1991 | Abe |
| 5,473,354 | A | | 12/1995 | Arquilevich et al. |
| 5,561,453 | A | * | 10/1996 | Shibata et al. ..... 347/85 |
| 5,602,577 | A | | 2/1997 | Shibata et al. |
| 5,988,801 | A | | 11/1999 | Coiner |
| 6,068,370 | A | | 5/2000 | Miller et al. |
| 2005/0083382 | A1 | * | 4/2005 | Shiho et al. ..... 347/85 |
| 2005/0140752 | A1 | * | 6/2005 | Shiho et al. ..... 347/85 |

OTHER PUBLICATIONS

Patent Abstracts of Japan 57210879, vol. 007, No. 0687, Dec. 24, 1981.

Patent Abstracts of Japan 61054941, vol. 10, No. 068, Mar. 19, 1986.

* cited by examiner

LIQUID SUPPLYING MEMBER, METHOD OF MANUFACTURING THE SAME, AND LIQUID EJECTION APPARATUS INCORPORATING THE SAME

This is a continuation-in-part application of U.S. patent application Ser. No. 10/374,526 filed on Feb. 27, 2003, now abandoned the disclosure of which is incorporated herein by reference.

BACKGROUND OF THE INVENTION

The invention relates to a liquid supplying member for supplying liquid contained in a liquid cartridge to a liquid ejection apparatus for effecting recording or printing operation. The invention also relates to a method of manufacturing such a liquid supplying member.

For instance, the liquid ejection apparatus, such as an ink jet recording apparatus, subjects an object to recording or printing by ejecting liquid to the object while a liquid ejection head is reciprocally actuated. Liquid to be ejected to the object (e.g., ink) is supplied from a liquid container (e.g., a liquid cartridge) to a liquid ejection head (e.g., a recording head).

In addition to the liquid ejection apparatus of the type having both a liquid ejection head and a liquid container mounted on a carriage that travels reciprocally, a liquid ejection apparatus of another type having only a liquid ejection head mounted on a carriage (off-carriage type) is also available as disclosed in Japanese Patent Publication No. 2001-212974A, for example.

In such an ejection apparatus of the off-carriage type, as the printer size (printable sheet size) is larger, a length of the drawing of the ink supplying tube is longer, and the dynamic loss (pressure loss) is larger in the liquid supplying tube ranging from the ink tank to the carriage. This necessitates the use of an ink supplying tube having a large inside diameter for each ink supplying tube.

In addition, most of the ink supplying tubes used in the off-carriage type apparatus have each an annular cross section. Accordingly, its flexural rigidity is basically large. Further, when the ink supplying tube having a large inside diameter is employed, the flexural rigidity of the tube is further increased. Accordingly, to overcome the flexural rigidity of the tube, the necessity arises of further increasing a driving force for the carriage. With increase of the flexural rigidity, the tube must be designed to have a large bending diameter. In any case, the result is a further size increase of the apparatus.

The ink supplying tube involves the following problems. It is necessary to suppress evaporation of water content as a major component of the ink solvent. Further, air is dissolved into the ink in the ink supplying tube to thereby reduce a degree of degassing in the ink. To cope with this, one may take a measure of increasing the thickness of the ink supplying tube. Where the tube thickness increase measure is taken, the flexural rigidity of the tube is more increased.

To improve the anti-water permeability and gas barrier properties of the ink supplying tube, there is a proposal to use two or more layers to construct the ink supplying tube. Where a multi-layer construction is introduced into the tube annular in cross section, it is basically unavoidable to increase the flexural rigidity. Where the measure to use two or more layers for the tube is employed, metal molds must be respectively used for forming those layers in the extrusion molding machine. This results in increase of cost to manufacture.

SUMMARY OF THE INVENTION

It is therefore an object of the present invention to provide a liquid supplying member in use for the liquid ejection apparatus in which a flexural rigidity of the ink supplying tube is reduced, and satisfactory anti-water permeability and gas barrier properties are realized at low cost, and to provide a liquid ejection apparatus provide with the liquid supplying tube It is also an object of the invention to provide a liquid supplying member in which the liquid ejection apparatus body can be made compact and the attaching operation of the liquid supplying member can be facilitated.

It is also an object of the invention to provide a method of manufacturing such a liquid supplying member, and a liquid ejection apparatus incorporating such a liquid supplying member.

In order to achieve the above objects, according to the invention, there is provided a liquid supplying member, for supplying liquid from a liquid container to a liquid ejection head which are provided in a liquid ejection apparatus, comprising:

a flexible base member, having a first face formed with at least one first groove;

a flexible first plate member, joined to the first face of the base member so as to seal at least a part of the at least one first groove to form at least one liquid supplying passage, through which the liquid is supplied from the liquid container to the liquid ejection head; and a first connector, monolithically formed with a first longitudinal end portion of the base member to connect the at least one groove to one of the liquid container and the liquid ejection head.

Since the first connector is monolithically formed with the base member, the labor is made unnecessary for attaching an individual connector to the liquid supplying member when the liquid supplying member is attached to the liquid container or the liquid ejection head.

Preferably, the first connector comprises at least one tubular member. That is, the shape of the connecting section is made similar to that of the conventional polyethylene tube. Therefore, it is not necessary to apply any design change to a device-side connector of the liquid container or the liquid ejection head.

Here, it is preferable that the tubular member is protruded from an end face of the first longitudinal end portion. In this case, the liquid supplying member can be handled as in the conventional polyethylene tube.

It is also preferable that a plurality of first grooves and a plurality of tubular members are provided in a one-by-one manner. In this case, a plurality kinds of liquid can be supplied to the liquid ejection head by a single liquid supplying member with less space. Accordingly, the liquid ejection apparatus can be downsized.

It is further preferable that the first connector further comprises a coupler which connects adjacent ones of the tubular members to fix a relative position therebetween. In this case, the attachment of the liquid supplying member can be further facilitated.

Preferably, the base member and the first connector are formed from an identical material. In this case, the manufacturing cost for the liquid supplying member can be reduced. More preferably, the base member and the first connector are formed from a thermoplastic elastomer. In this case, since excellent flexibility can be attained, the liquid supplying member can be routed in the liquid ejection apparatus with less space.

Alternatively, it is preferable that the base member is formed from a first material, and the first connector is formed from a second material which is harder than the first material. In this case, the durability of the first connector is enhanced.

Preferably, the first plate member is joined to the base member such that the at least one first groove is exposed at the first longitudinal end portion of the base member. The first longitudinal end portion is directly connected to one of the liquid container and the liquid ejection head to serve as the first connector. In this case, the manufacturing cost for the liquid supplying member can be reduced.

Preferably, the liquid supplying member further comprises a second connector monolithically formed with a second longitudinal end portion of the base member to connect the at least one first groove to the other one of the liquid container and the liquid ejection head.

Preferably, the base member has a second face which is opposite to the first face and formed with at least one second groove which is communicated with the first groove at a longitudinal intermediate portion of the base member. Here, the liquid supplying member further comprises: a flexible second plate member joined to the second face of the base member so as to seal at least a part of the at least one second groove; and a second connector monolithically formed with a second longitudinal end portion of the base member to connect the at least one second groove to the other one of the liquid container and the liquid ejection head.

In this case, even when the liquid supplying member is bent into an S-shape, the direction of bend can be such that the base member contracts throughout its length. Thus, even when the liquid supplying member is bent into an S-shape, the plate members hardly separate from the base member.

According to the invention, there is also provided a method of manufacturing a liquid supplying member, for supplying liquid from a liquid container to a liquid ejection head which are provided in a liquid ejection apparatus, comprising steps of:

forming a first member comprising:

a flexible base member, having a first face formed with at least one first groove; and a first connector, monolithically formed with a first longitudinal end portion of the base member and communicated with the at least one first groove; and joining a flexible second member to the first face of the base member so as to seal at least a part of the at least one first groove to form at least one liquid supplying passage, through which the liquid is supplied from the liquid container to the liquid ejection head.

With such a configuration, the liquid supplying member can be fabricated with less cost Preferably, the first member is formed by an injection molding.

According to the invention, there is also provided a liquid ejection apparatus, comprising:

a liquid ejection head, which ejects liquid toward an object;

a liquid container, which stores liquid to be ejected by the liquid ejection head; and a liquid supplying member, adapted to supply the liquid in the liquid container to the liquid ejection head, the liquid supplying member comprising:

a flexible base member, having a first face formed with at least one first groove;

a flexible first plate member, joined to the first face of the base member so as to seal at least a part of the at least one first groove to form at least one liquid supplying passage, through which the liquid is supplied from the liquid container to the liquid ejection head; and a first connector, monolithically formed with a first longitudinal end portion of the base member to connect the at least one groove to one of the liquid container and the liquid ejection head.

The outline of the invention provided the above does not list all the features necessary in the present invention. Thus, a sub-combination of these feature groups can constitute the invention.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Preferred embodiments of the invention will be described below in detail with reference to the accompanying drawings.

Figure 1:
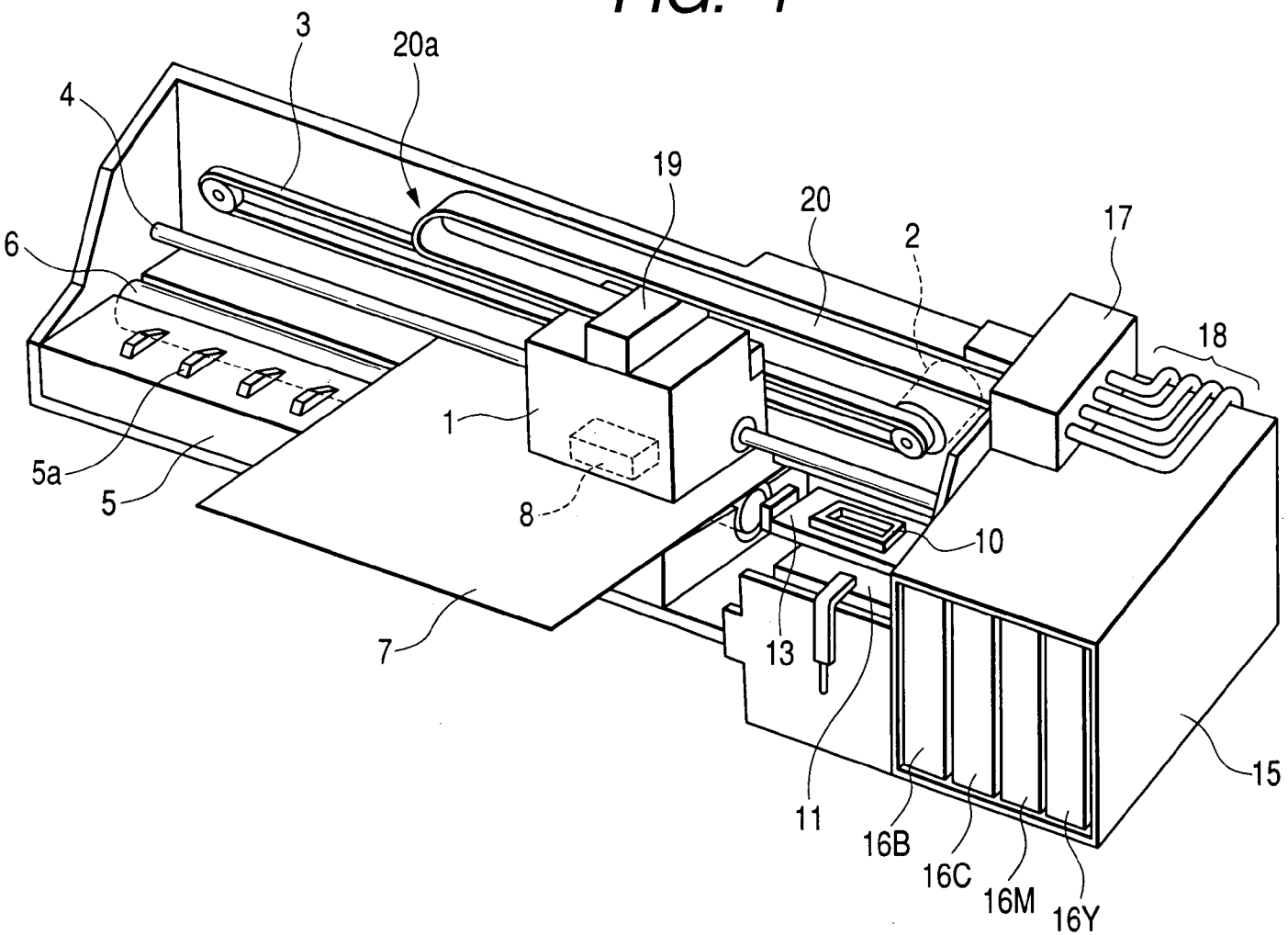
FIG. 1 is a perspective view showing an overall construction of a liquid ejection apparatus incorporating a liquid supplying member according to a first embodiment of the invention.

FIG. 1 shows an ink jet recording apparatus as an example of a liquid ejection apparatus incorporating a liquid supplying member according to a first embodiment of the invention In the recording apparatus, a carriage 1 is reciprocatively moved in the primary scanning direction which extends along a longitudinal direction of a sheet feeder 5, while being guided by a guide member 4 with the aid of a timing belt 3 driven by a carriage motor 2

The sheet feeder 5 is provided with a sheet feeding roller 6. A recording sheet 7, nipped between the sheet feeding roller 6 and a follower roller (not shown), is transported by rotation of the sheet feeding roller 6 in a secondary scanning direction orthogonal to the primary scanning direction. A number of protrusions 5*a* are intermittently arrayed in the longitudinal direction on the upper face of the sheet feeder 5. The recording sheet 7 is transported along the top faces of the thus arrayed protrusions 5*a*.

An ink jet recording head 8, as indicated by a dashed line, is mounted on the lower face of the carriage 1, which faces the recording sheet 7. The recording head 8 ejects ink drops onto the recording sheet 7 at proper timings according to print data so as to print an image on the recording sheet 7.

A capping device 10 is disposed in a non-printing region (home position). When the recording head 8 moves to just above the capping device 10, the capping device 10 moves upward and seals a nozzle formation face of the recording head (the bottom face of the recording head 8 in this embodiment). A suction pump 11 for applying a negative pressure to the inner space of the capping device 10 is disposed under the capping device 10.

During a period that the recording device is deactivated, the capping device 10 serves as a nozzle cover which suppresses evaporation of the ink solvent. At the same time, a cleaning operation for the maintenance of the recording head on its ink drop ejecting function is also performed in a manner that a negative pressure is applied from the suction pump 11 to the recording head 8 to thereby suck ink from the recording head.

As shown in FIG. 1, a strip-shaped wiper 13 made of an elastic material such as rubber is disposed in a printing region adjacent to the capping device 10. When the carriage 1 is reciprocatively moved to the capping device 10, the wiper 13 horizontally moves to and from the moving path of the recording head as required, and wipes the nozzle formation face of the recording head 8 to clean the surface.

As shown in FIG. 1, a tank holder 15 is provided on the side end (right end in FIG. 1) of the apparatus. Ink tanks are removably attached to the tank holder 15 from the front side of the apparatus. The ink tanks are a black ink tank 16B for supplying black ink, and color ink tanks 16C, 16M and 16Y for supplying color ink of cyan, magenta, and yellow.

Ink supplying pipes 18 are connected the tank holder 15 on which those ink tanks are mounted to a first connector 17 mounted on the upper side of the tank holder 15. The respective colors of ink are supplied from the respective ink tanks to the first connector 17 through the ink supplying pipes 18.

In the embodiment, an outer case of each ink tank, not shown in particular, is hermetically constructed. A flexible ink pack filled with ink is contained in each tank case. A pressurized air is supplied to the outer case forming the ink tank, whereby the ink is pushed out by the pressurized air.

A second connector 10 is mounted on the upper side of the carriage 1. The ends of an ink supplying tube 20 are connected to the first and second connectors 17 an 19 with the aid of connection members to be described later, respectively. With such an mechanical arrangement, the respective colors of ink are supplied from the ink tanks to the carriage side, and the recording head 8 ejects ink drops onto the recording sheet 7 in accordance with print data.

In the embodiment, an elongated flat tube is adopted as the ink supplying tube 20. A belt-shaped flat portion of the ink supplying tube 20 is laterally extended from the first connector 17 such that belt-shaped flat faces are made horizontal. The ink supplying tube 20 is returned horizontally via a U-shaped bent portion 20*a* and connected to the second connector 19. In accordance with the movement of the carriage 1, the bent portion 20*a* accordingly moves along the longitudinal direction of the ink supplying tube 20.

Figure 2:
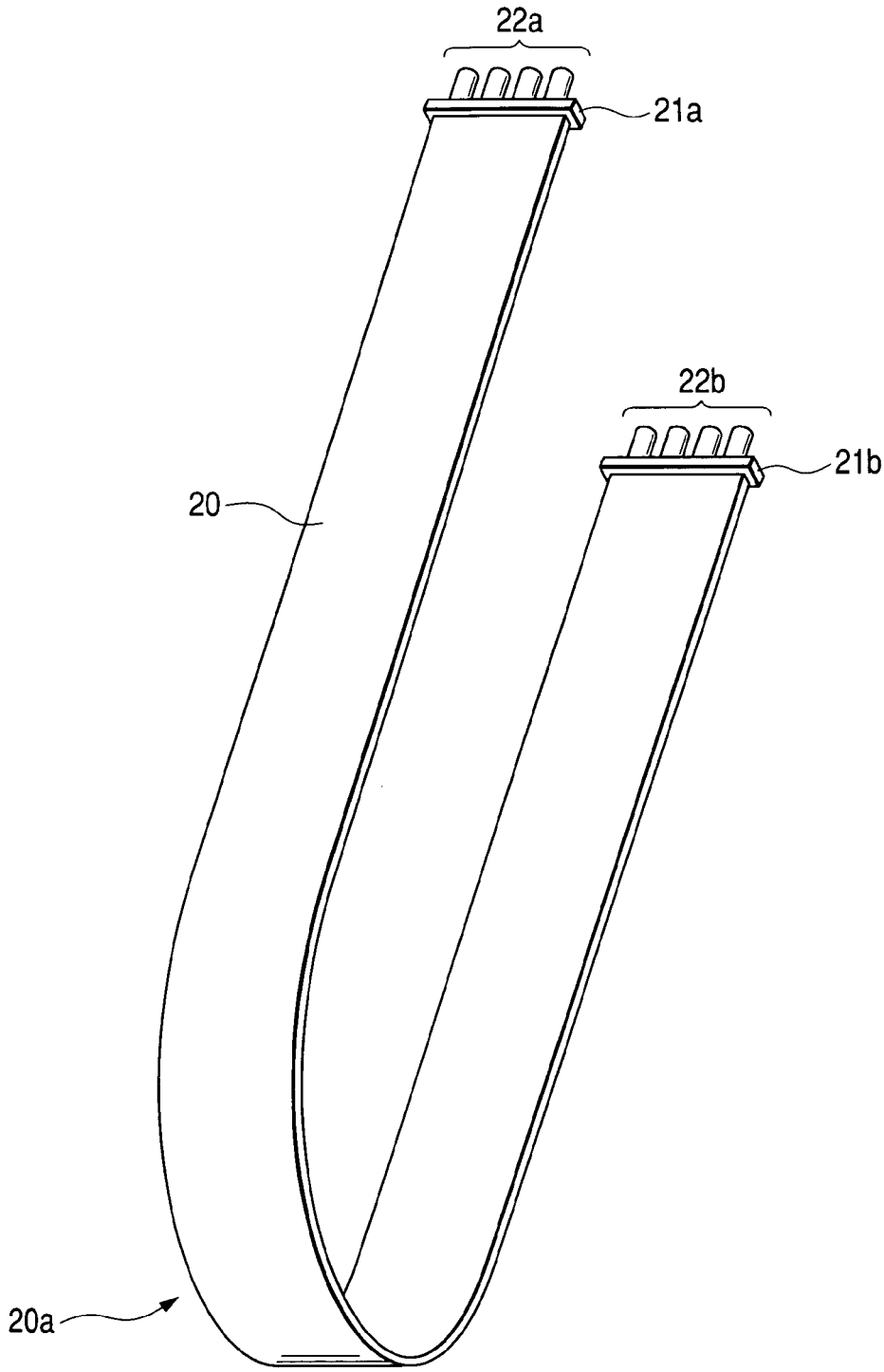
FIG. 2 is a perspective view of the liquid supplying member.

As shown in FIG. 2, first and second connection members 21*a* and 21*b*, made of synthetic resin, are attached to the ends of the ink supplying tube 20, respectively. In the embodiment, an arrangement is made to supply the respective colors of ink from the four ink tanks 16B, 16C, 16M and 16Y to the recording head 8. Accordingly, four cylindrical connection pipes 22*a* and 22*b* are formed on the first connection members 21*a* and 21*b*.

The connection pipes 22*a* formed on the first connection member 21*a* are connected to the first connector 17 shown in FIG. 1, and the four connection pipes 22*b* formed on the second connection member 21*b* are connected to the second connector 19 shown in FIG. 1. With such a configuration, the respective colors of ink are supplied to the recording head a mounted on the carriage 1.

Figure 3:
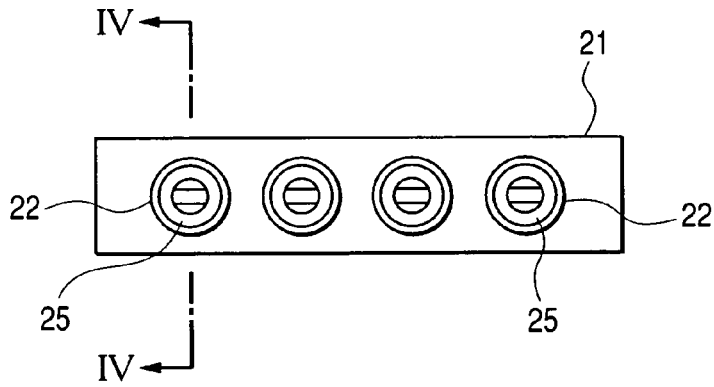
FIG. 3 is an enlarged, front view showing an end portion of the liquid supplying member of FIG. 2.

FIG. 3 shows the first and second connection members 21*a* and 21*b* when viewed from the end thereof. The first and second connection members 21*a* and 21*b* are configured to have the same shape. In this sense, those connection members are designated generally by a reference numeral 21 in FIGS. 3 to 6. The cylindrical connection pipes formed on the connection members are also designated generally by a reference numeral 22.

Figure 5:
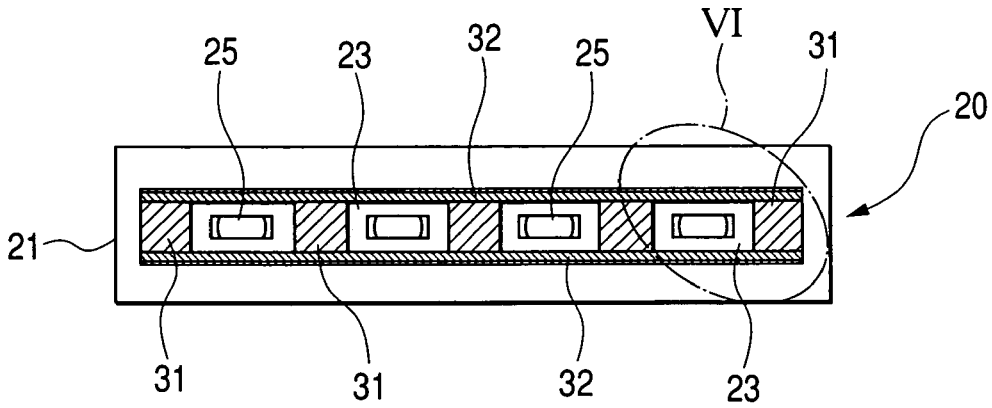
FIG. 5 is a section view taken along a line V—V in FIG. 4.

As shown in FIG. 5, the ink supplying tube 20 contains five elongated elastic members 31, made of elastomer, which are arrayed at regular intervals and extending in parallel. Elongated film members 32 are hermetically joined to upper and lower faces, of the elastic members 31 by heat welding process.

Figure 6:
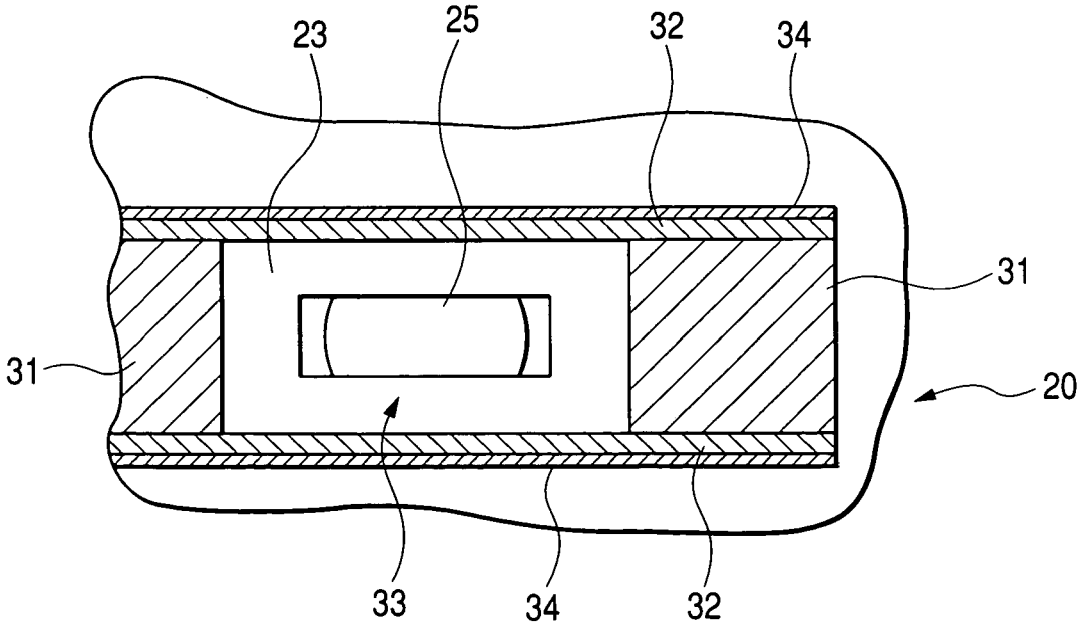
FIG. 6 is an enlarged view of a part VI in FIG. 5.

Four spaces, which are defined by the adjacent elastic members 31 and the upper and lower film members 32, are used as ink supplying passages 33 as shown in FIG. 6. In other words, those ink supplying passages 33 are partitioned by the elastic members 31. With use of elastomer in particular for the elastic members 31, the heat welding of a synthetic resin material constituting the elastomer to a synthetic resin material forming the film members 32 is made easy. Execution of the heat welding ensures a good hermeticity thereat.

In this case, a relatively elastic material may be selected for the elastomer. Accordingly, the flat face of the ink supplying tube 20 may smoothly be bent as shown in FIGS. 1 and 2. As a result, a degree of resistance of the ink supplying tube 20 to the reciprocal motion of the carriage 1 is remarkably reduced. As shown in FIG. 6, thin films 34 are formed, in advance, on the surfaces of the film members 32 by an aluminum lamination process. With the use of the thin films 34, the gas barrier properties and the anti-water permeability of the ink supplying tube are effectively given to the ink supplying tube 20.

Figure 4:
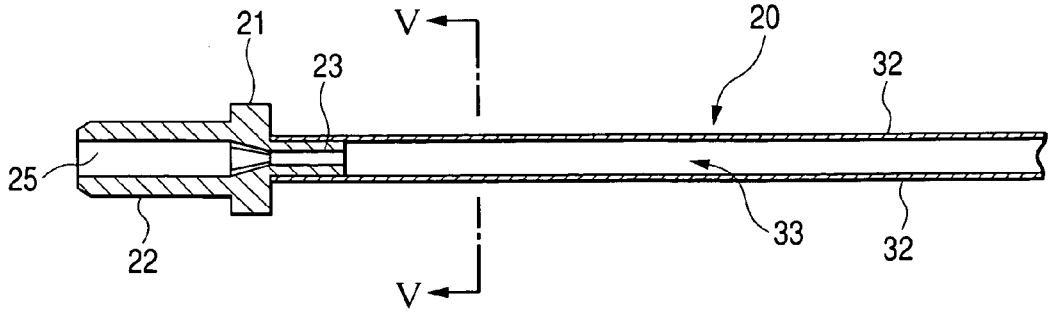
FIG. 4 is a section view taken along a line IV—IV in FIG. 3.

As shown in FIGS. 3 and 4, the connection member 21, which is mounted on each end of the ink supplying tube 20, includes a prism-shaped connection pipe 23 which is located at a position opposed to each cylindrical connection pipe 22. Openings 25 are formed in the connection member 21 while passing through the connection pipes 22 and 23. The connection pipe 23 is communicatively connected to the ink supplying passage 33 at each end of the ink supplying tube 20.

The connection pipe 23 is press-fitted into the space between the adjacent elastic members 31, and the film members 32 is heat welded to the upper and lower faces of the connection pipe 23 as shown in FIG. 6. The side faces of the connection pipe 23 to be press-fitted are preferably coated with adhesive in advance. By so doing, satisfactory hermeticity is kept between the side faces of the connection pipe 23 and the elastic members 31 after the fitting. In an alternative, the film member 32 is made of resin having the compatibility to the elastomer of the elastic material 31, and is made to integral with the elastic material 31 by insertion molding, for example.

Figure 7:
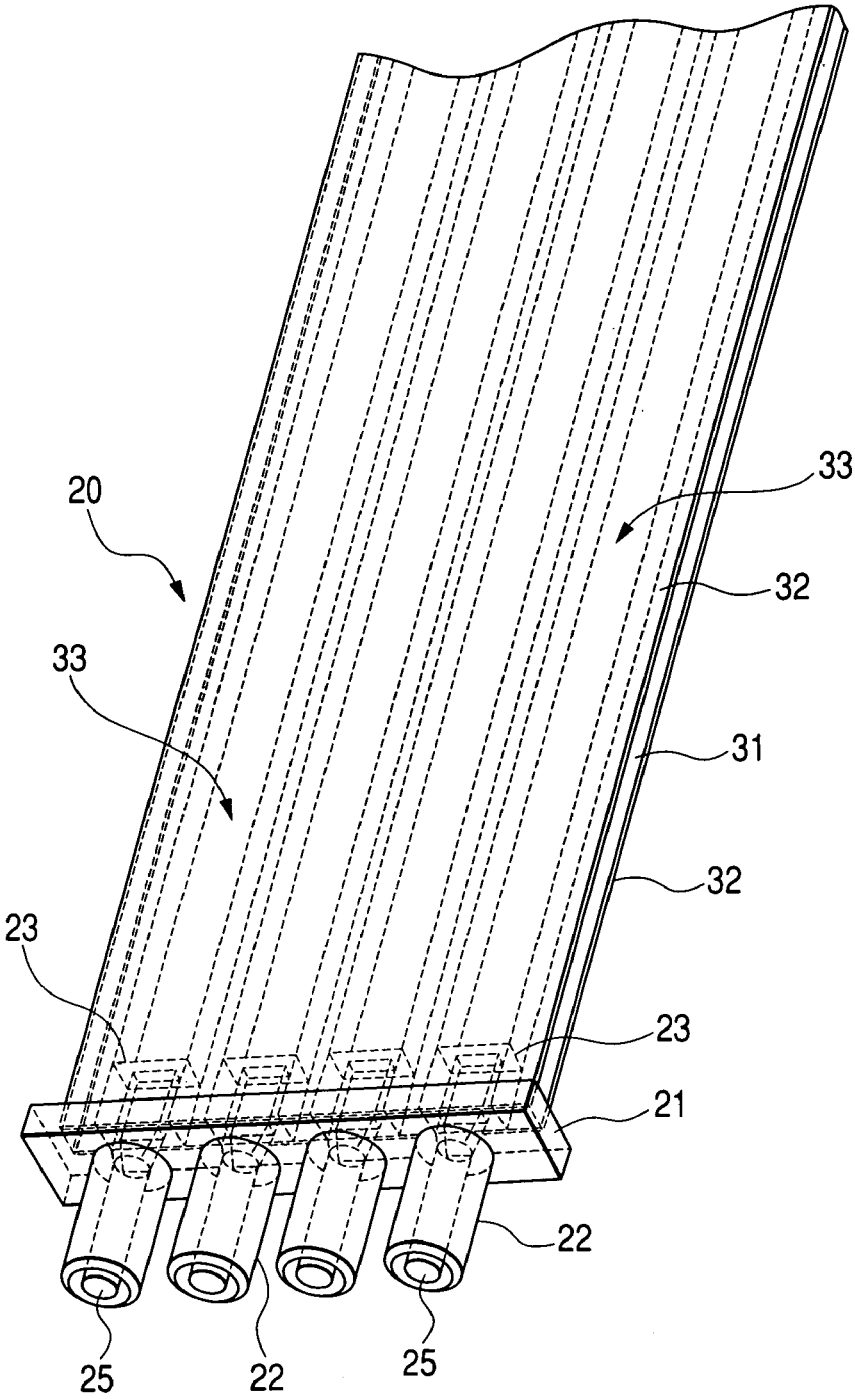
FIG. 7 is a perspective view of the liquid supplying member of FIG. 2.

FIG. 7 perspectively shows a state that the connection member 21 are fitted to the end of the ink supplying tube 20.

In the recording apparatus of the off-carriage type, with the reciprocal movement of the carriage 1, the ink in the ink supplying tube 20 receives an acceleration force. In this case, the acceleration force frequently causes the pressure fluctuation of ink in the recording head 8. To cope with this, generally a damper member is mounted on the carriage 1 to thereby absorb the fluctuation of the ink pressure.

However, in the ink supplying tube 20 described above, the ink supplying passages 33 are each surrounded by the elastic members 31 and the film members 32. With an elasticity of the film members 32 in particular, the damper function is secured. In this respect, the invention provides a recording device which is not provided with any special damper member by using the ink supplying tube 20.

Figure 8:
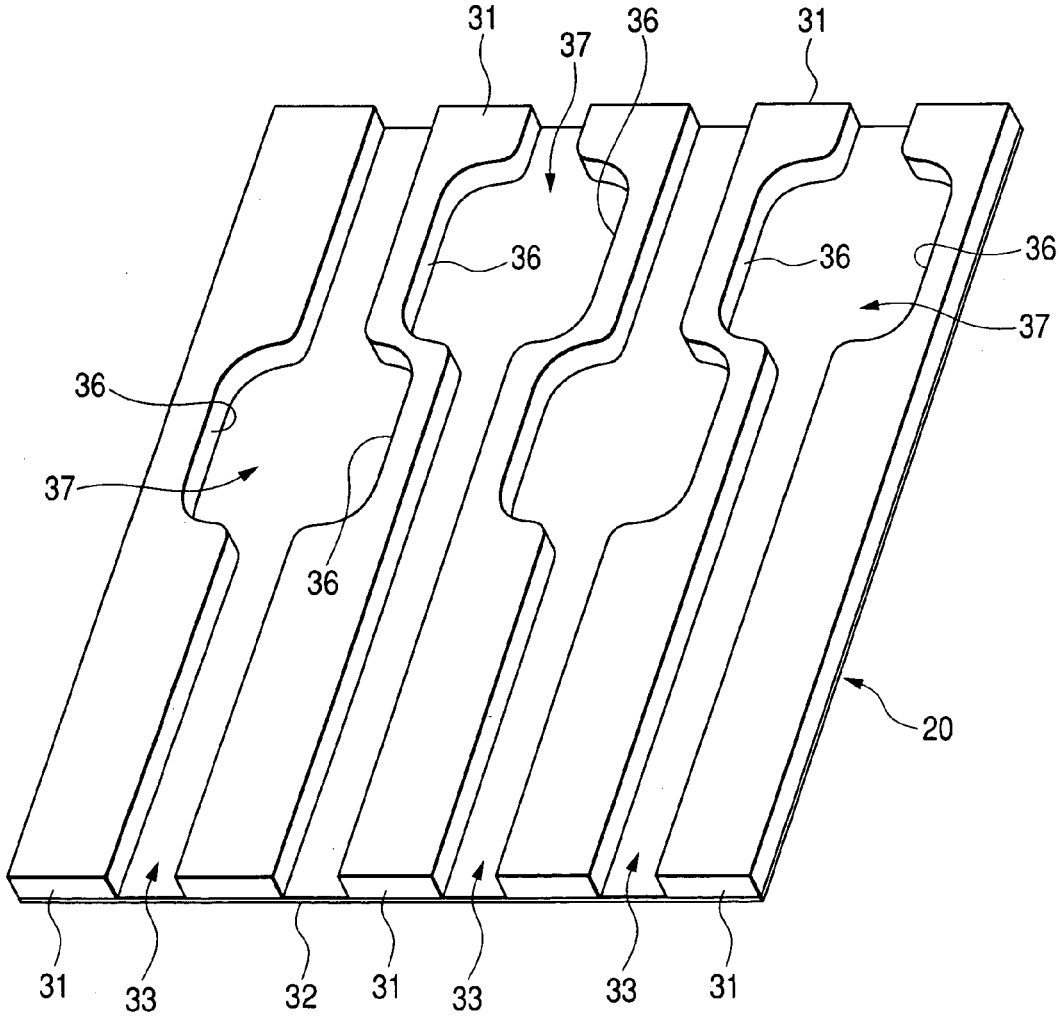
FIG. 8 is a disassembled perspective view of a modified example of the liquid supplying member of FIG. 2.

In a case where the damper function by the film members 32 is insufficient, recessed portions 36 may be formed at opposed positions of the elastic members 31 as shown in FIG. 8. As a result, a space between the opposed positions of the elastic members 31 is increased to form an enlarged space 37. Incidentally, FIG. 8 shows a state that the upper film member 32 is removed.

In the ink supplying tube thus constructed, broad areas resulting from presence of the enlarged spaces 37 are secured at portions of the ink supplying tube 20, whereby the damper function is effectively exhibited. The enlarged spaces 37 are preferably located at downstream positions of the ink supplying passages 33 of the ink supplying tube 20, that is, closer to the carriage 1.

Figure 9A:
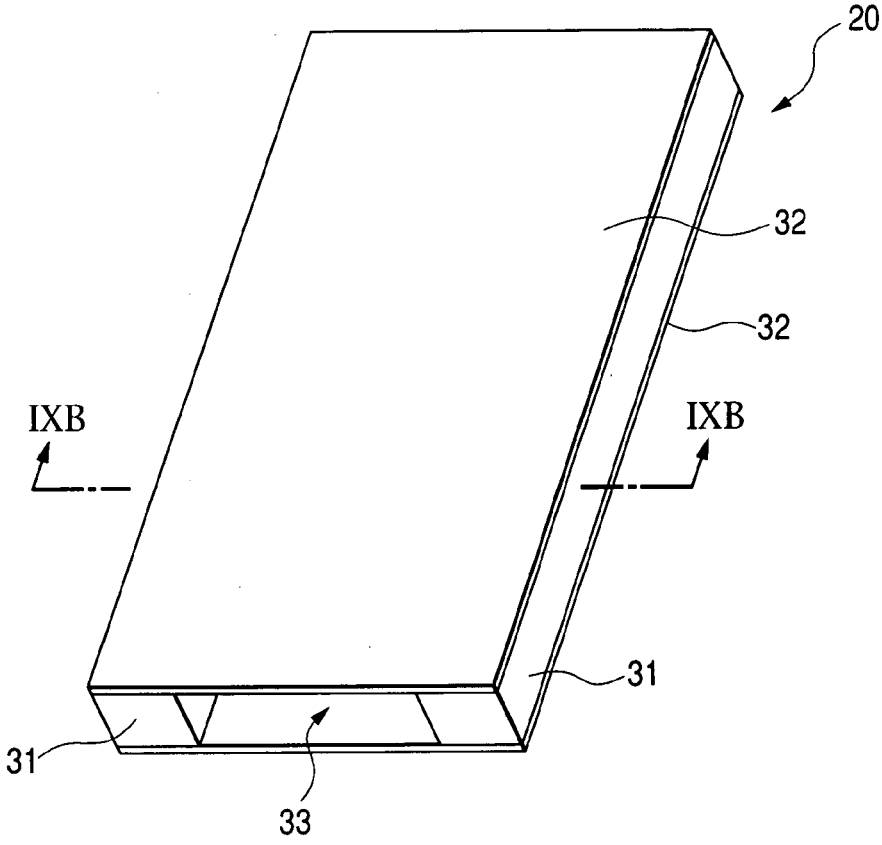
FIG. 9A is a partial perspective view of a liquid supplying member according to a second embodiment of the invention.
Figure 9B:
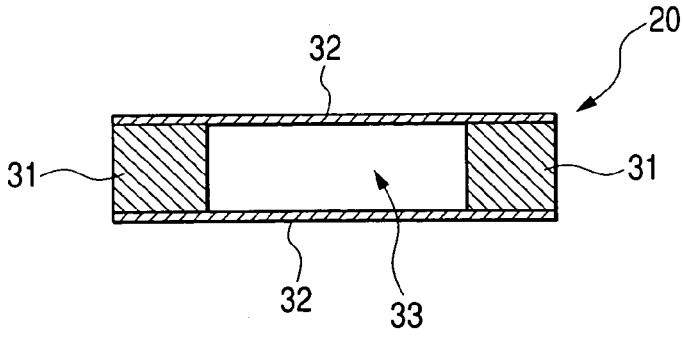
FIG. 9B is a section view taken along a line IXB—IXB in FIG. 9A.

FIGS. 9A and 9B show an ink supplying tube according to a second embodiment of the invention. The members as same as those explained in the first embodiment are designated by the same reference numerals, and repetitive explanations will be omitted.

In this embodiment, since a single ink supplying passage 33 is provided in a single ink supplying tube 20, four independent tubes are to be incorporated in the apparatus shown in FIG. 1.

Although it is not explicitly shown in these figures, it is preferable to form thin films 34 on the outer faces of the film member 32 by aluminum lamination process, as in the case shown in FIG. 6.

Figure 10A:
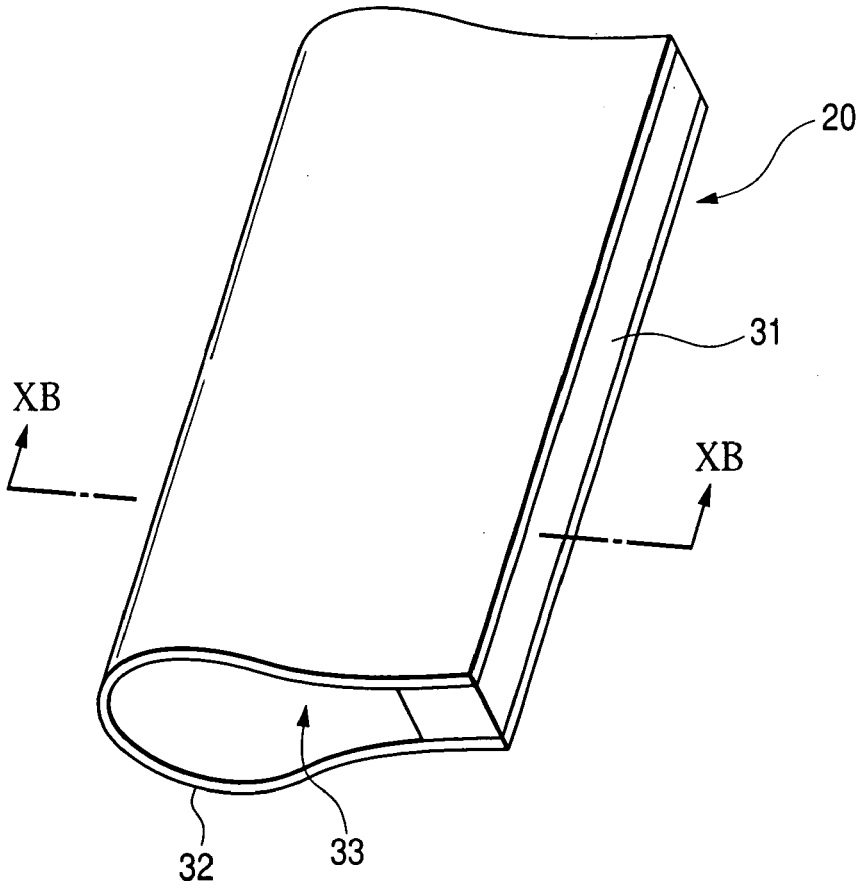
FIG. 10A is a partial perspective view of a liquid supplying member according to a third embodiment of the invention.
Figure 10B:
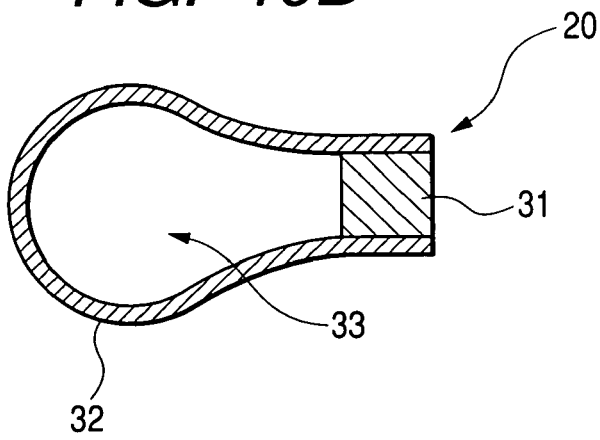
FIG. 10B is a section view taken along a line XB—XB in FIG. 10A.

FIGS. 10A and 10B show an ink supplying tube according to a third embodiment of the invention. The members as same as those explained in the first embodiment are designated by the same reference numerals, and repetitive explanations will be omitted.

In this embodiment, a single film member 32 is hermetically joined to the upper and lower faces of the elastic member 31 to define an ink supplying passage in an enclosing manner.

The film member 32 is joined to both sides of the elastic member 31 in a bag shape to thereby form an ink supplying passage 33. With such a structure, of a peripheral length of the inner surface of the ink supplying passage 33, a part defined by the film member 32 is longer than a part defined by the elastic member 31, i.e., a thickness of the elastic member 31.

As in the second embodiment, since a single ink supplying passage 33 is provided in a single ink supplying tube 20, four independent tubes are to be incorporated in the apparatus shown in FIG. 1.

Although it is not explicitly shown in these figures, it is preferable to form thin films 34 on the outer faces of the film member 32 by aluminum lamination process, as in the case shown in FIG. 6.

Figure 11:
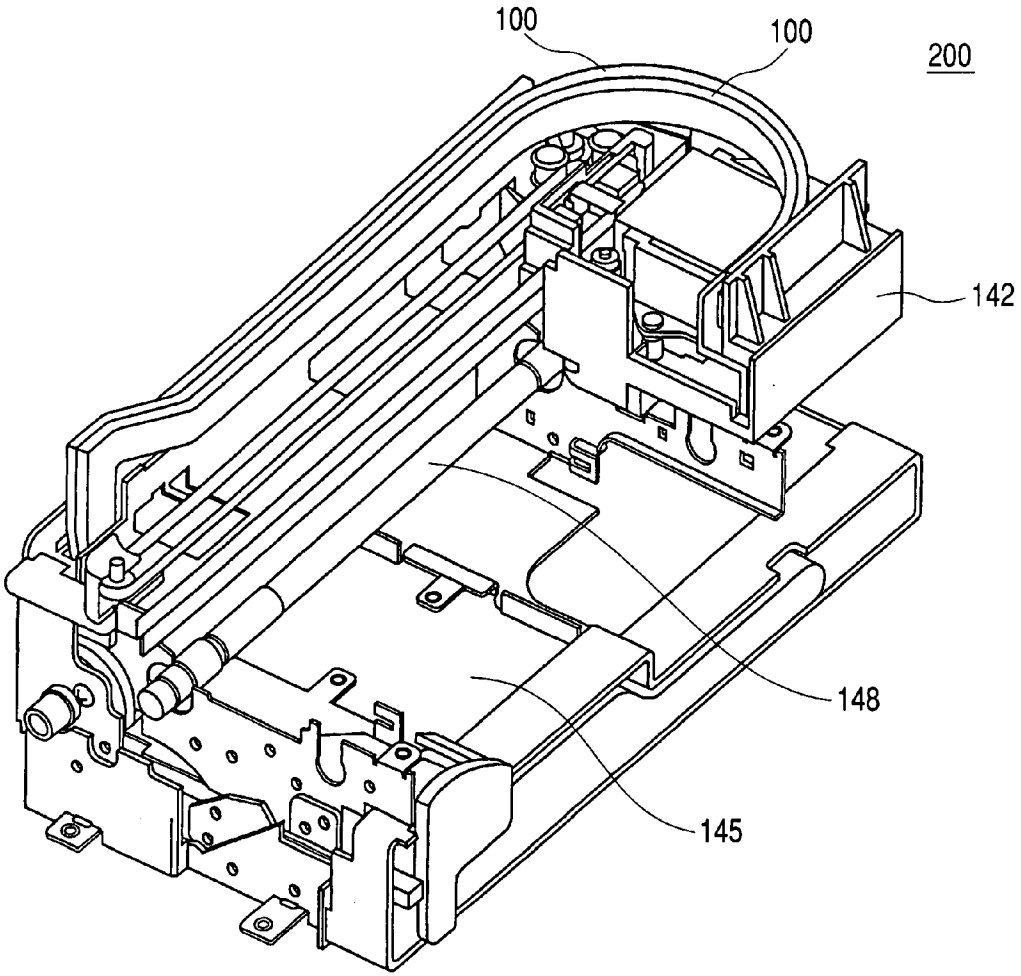
FIG. 11 is a perspective view of an ink jet recording apparatus.
Figure 12:
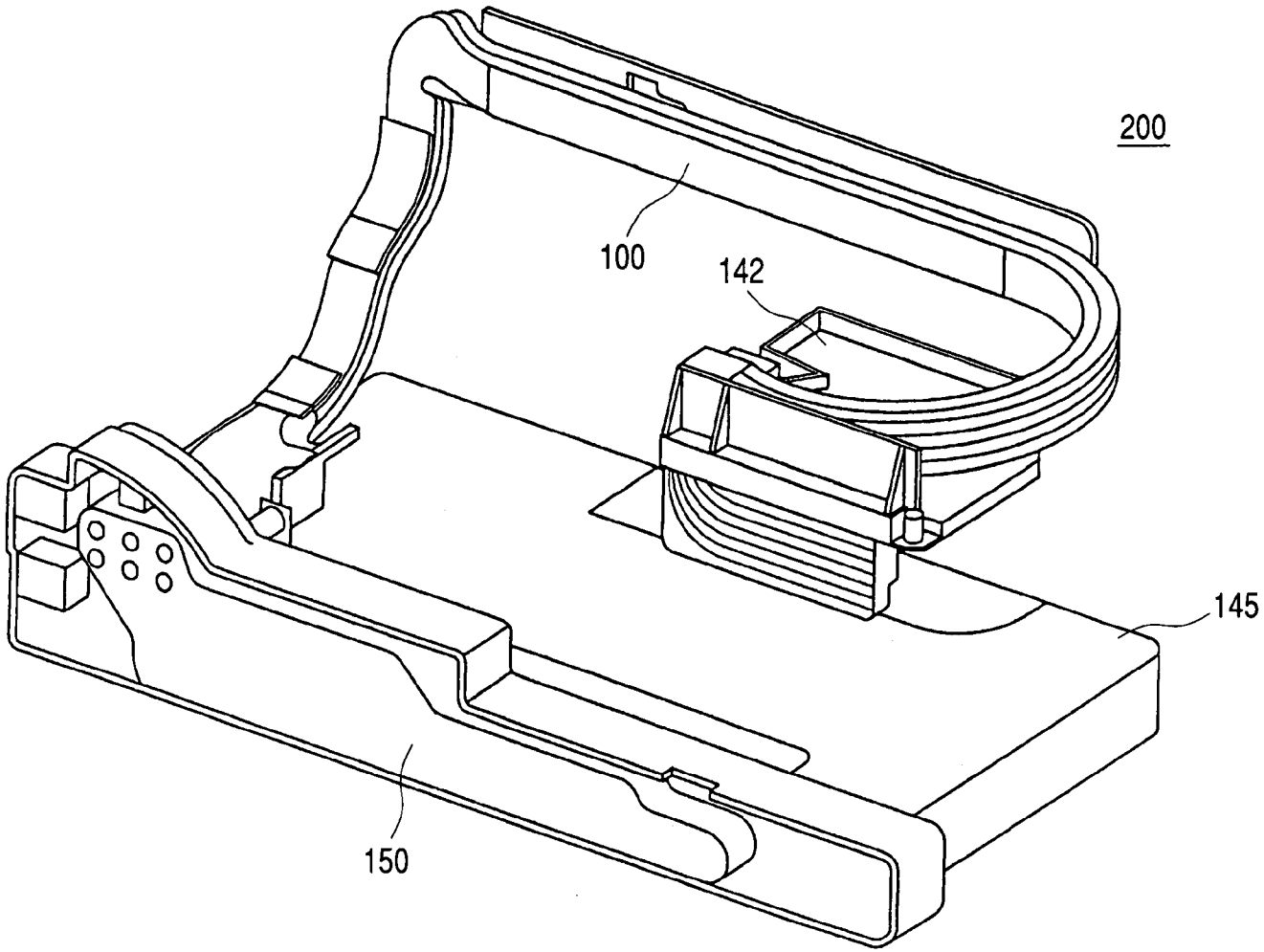
FIG. 12 is a perspective view of the ink jet recording apparatus in a disassembled state.

FIGS. 11 and 12 show an ink jet recording apparatus 200 incorporating a liquid supplying member 100 according to a fourth embodiment of the invention. The ink jet recording apparatus 200 further comprises: a carriage 142 performing a reciprocating motion over a recording medium not shown; a recording head (not shown) mounted on the carriage 142 so as to eject plural colors of ink onto the recording medium and thereby perform recording or the like; a plurality of cartridges 145 each storing one of the plural colors of ink. The carriage 142 is reciprocated along a guide shaft 148 by a motor not shown. The cartridges 145 are fixed on a main body of the ink jet recording apparatus 200. The liquid supplying member 100 is an elongated member and its main part is formed with a flexible material (such as a thermoplastic elastomer). The liquid supplying member 100 has a required number (a plural number, in this embodiment) of passages so as to supply plural colors of ink stored respectively in a plurality of the cartridges 145 to the recording head performing the reciprocating motion. The recording head ejects the ink onto the recording medium located in a liquid ejecting region, that is, under the traveling path of the recording head, so as to perform recording or the like. The plural colors of ink stored in the cartridges 145 are supplied from the cartridges 145 through fixed passages 150 to one end of the liquid supplying member 100.

With the above configuration, when merely the single liquid supplying member 100 is attached, the plural colors of ink stored respectively in the cartridges 145 can be supplied to the recording head. This permits size reduction in the ink jet recording apparatus 200, and further reduces the labor necessary in attaching the liquid supplying member 100.

When an elastomer comprised mainly of an SEPS (polystyrene-polyethylene-polypropylene-polystyrene) polymer is used as the flexible material for composing the liquid supplying member 100, the liquid supplying member 100 is more flexible than a polyethylene tube. This allows the liquid supplying member 100 to be bent more sharply, and hence permits further size reduction in the ink jet recording apparatus 200. Further, during the carriage driving, the load is reduced on the motor for driving the carriage 142.

The ink jet recording apparatus 200 is an example of the liquid ejection apparatus. The recording head of the ink jet recording apparatus is an example of the liquid ejection head of the liquid ejection apparatus. The cartridge 145 is an example of a liquid container of the liquid ejection apparatus.

Figure 13:
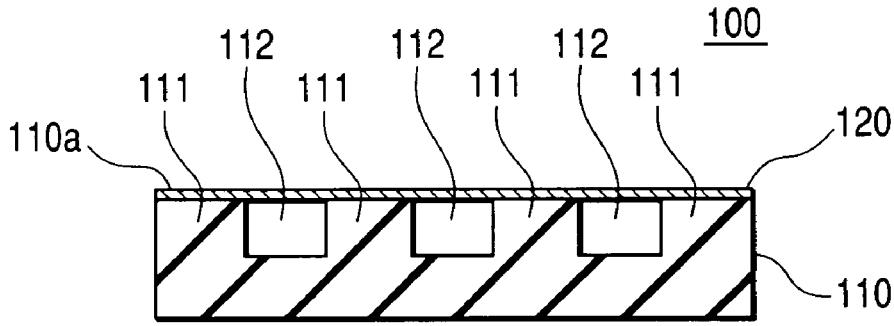
FIG. 13 is a transverse section view of a liquid supplying member according to a fourth embodiment of the invention.

As shown in FIG. 13, the liquid supplying member 100 comprises: a base member 110 formed with a flexible material; and an elongated plate member 120 joined to one face 110*a* of the base member 110. In this embodiment, the elongated plate member 120 is joined to the one face 110*a* by adhesion, welding, or the like. The elongated plate member 120 has flexibility with or without the base member 110.

The cross section of the base member 110 is almost rectangular. The one face 110*a* has a plurality of grooves 112 extending in the longitudinal direction and arranged in the width direction of the one face 110*a* with separation from each other. The cross section of the groove 112 in this embodiment is rectangular. These grooves are formed as gaps between a plurality of ridges 111. The elongated plate member 120 covers the opening face of the grooves 112. More specifically, the elongated plate member 120 covers the upper face of the ridges 111, and is joined across the width of the base member 110, so as to cover the opening side of the grooves 112. As a result, the grooves 112 serve as ink supplying passages.

Such a structure enables manufacture of the liquid supplying member 100 by injecting plastic material (e.g., a thermoplastic elastomer) into a mold, to thereby mold the base member 110. In this case, the base member 110 can be formed into a complicated geometry, and manufacturing costs can be reduced. In addition to the SEPS polymer, the plastic material constituting the liquid supplying member 100 preferably includes paraffin oil serving as a softening agent. Further, the plastic material may contain polypropylene along with or separately from the paraffin oil.

Among the ridges 111, ones provided at both widthwise ends of the base member 110 are wider than the remaining ridges 111. By such a configuration, the quantity of ink solvent (e.g., water) permeating through the base member 110 and the quantity of outside air which permeates through the base member 110 and dissolves in ink can be reduced.

Figure 14:
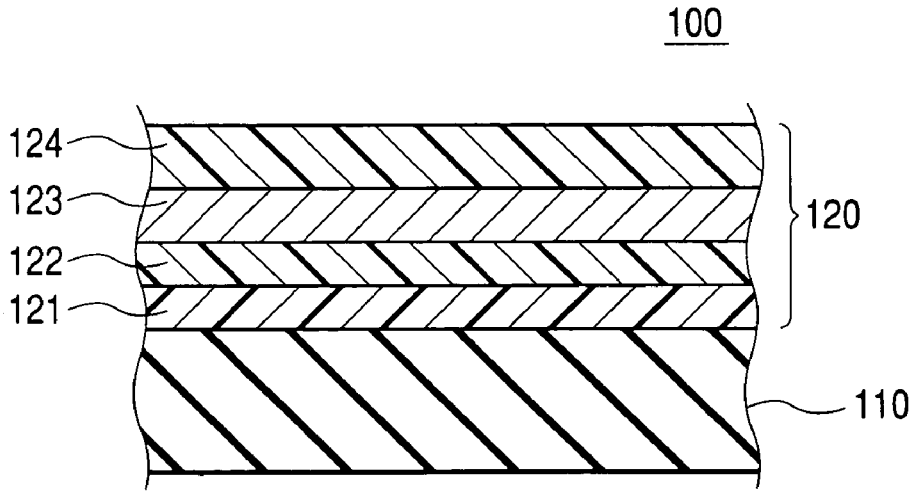
FIG. 14 is an enlarged section view of an elongated plate member of the liquid supplying member of FIG. 13.

As shown in FIG. 14, the elongated plate member 120 has a multilayered structure in which a welding layer 121, a reinforcement layer 122, a metal layer 123, and a protective layer 124 are laminated, in the order given from the base member 110.

The welding layer 121 is for joining the elongated plate member 120 to the base member 110 by welding. In a case where the base member 110 includes the polypropylene as well as the SEPS, the welding layer 121 is formed from polyethylene or polypropylene.

The reinforcement layer 122 is for reinforcing the elongated plate member 120. The reinforcement layer 122 also serves to improve the heat resistance of the elongated plate member 120. Specifically, the reinforcement layer 122 is formed from polyamide.

The metal layer 123 is formed of an aluminum foil, for example. Providing the metal layer 123, the elongated plate member 120 serves to prevent evaporation of a solvent (water, for example) contained in ink. The metal layer 123 also serves to prevent exterior air from penetrating through the elongated plate member 120 and dissolving in the ink.

The protective layer 124 serves to protect the metal layer 123 physically and thermally, and is formed from, e.g., polyethylene terephthalate. The protective layer 124 also serves to reinforce the elongated plate member 120.

Figure 18:
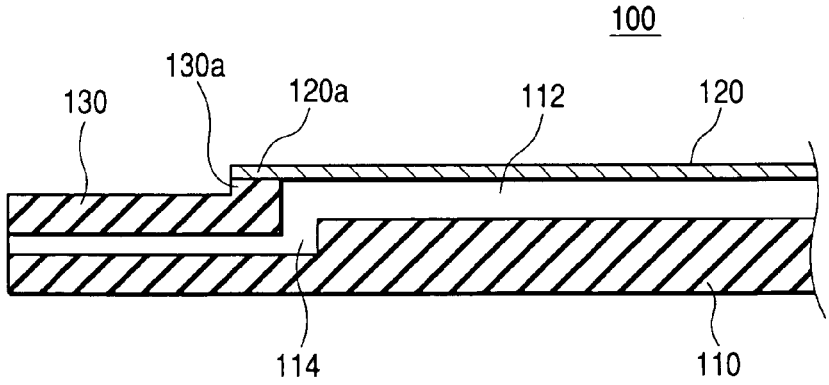
FIG. 18 is a longitudinal section view showing the liquid supplying member of FIG. 13.

The liquid supplying member 100 can be flexed in a direction orthogonal to the face 210*a* of the base member 110 as shown in FIG. 18 Since the base member 110 has elasticity higher than that of the elongated plate member 120, it is preferable to bent the liquid supplying member 100 such that the base member 110 faces inwards. In this case, the elongated plate member 120 becomes less prone to being exfoliated from the base member 110. Further, the elongated plate member 120 becomes less susceptible to slitting.

In this embodiment, the elongated plate member 120 and the base member 110 are joined to each other by welding. However, they may be joined by a joining method other than the welding, that is, they may be joined by adhesive or the like.

Figure 15:
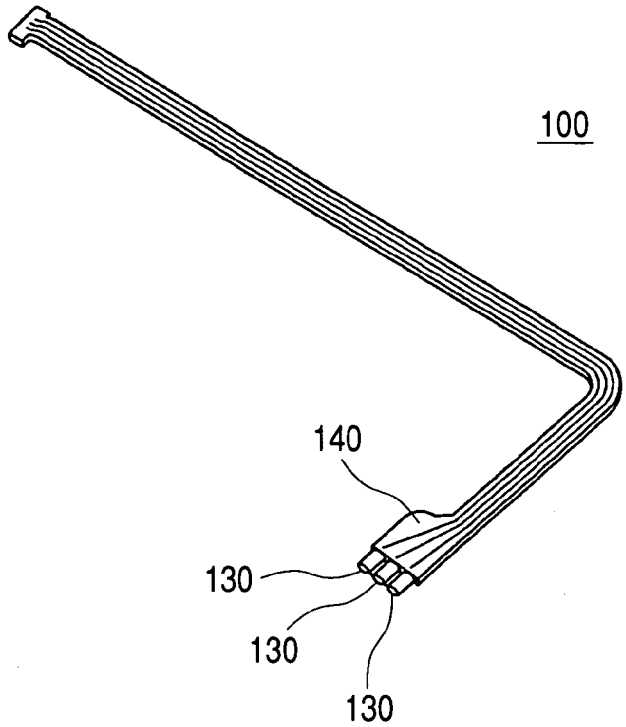
FIG. 15 is a perspective view showing the liquid supplying member of FIG. 13.
Figure 16:
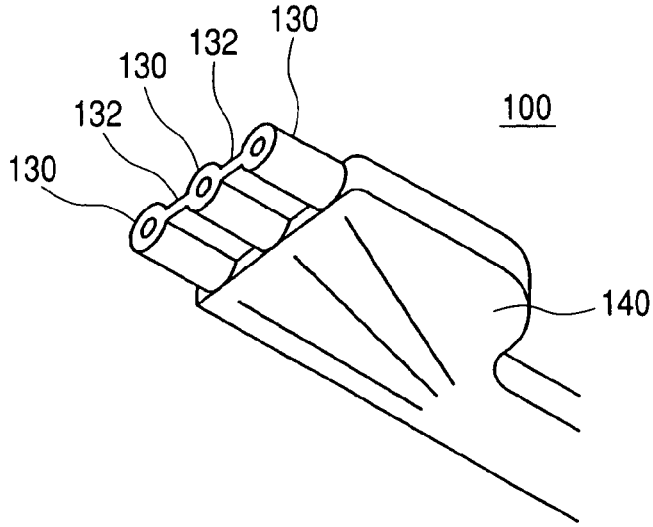
FIG. 16 is an enlarged perspective view showing one side of the liquid supplying member of FIG. 13.
Figure 17:
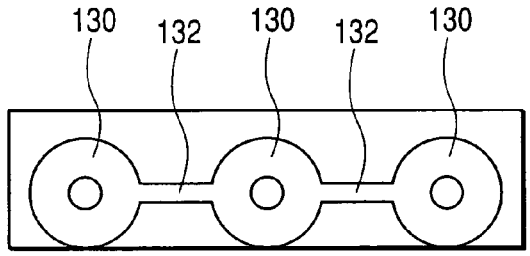
FIG. 17 is a front view showing the one side of the base member of the liquid supplying member of FIG. 13.

As shown in FIGS. 15 through 17, each of the two ends of the liquid supplying member 100 has a connecting section for connecting either the recording head or the cartridges 145. In this embodiment, the connecting section of at least one end (for example, the end to be connected to the cartridges 145) has cylindrical members 130. The cylindrical members 130 are provided with the same number as that of the grooves 112. One end of each cylindrical member 130 protrudes from the end face of the longitudinal direction of the base member 110 to the outside, so as to connect directly or indirectly with the recording head or the cartridge 145.

In the device-side (i.e., the recording head or the cartridges 145), a portion to which the cylindrical members 130 are connected may be configured as in the conventional structure The outer diameter of the cross section of the cylindrical member 130 is larger than the interval of the grooves 112. The purpose of this is to maintain the cross section of the ink passage of the cylindrical member 130 to be almost equal to that of the groove 112, and still to ensure certain durability in the cylindrical member 130. Thus, in order that a plurality of the cylindrical members 130 can be arrayed, the base member 110 is widened in the width direction at an end portion 140. At the same time, in order to connect with the respective cylindrical members 130, a plurality of the grooves 112 are extended obliquely relative to the width direction of the end portion 140.

The cylindrical member 130 is connected at an obtuse angle to the ridge 111 and the groove 112 in the end portion 140. This configuration reduces the pressure loss in the ink at the connecting section between the cylindrical member 130 and the groove 112. In particular, in this embodiment, the orientation of the cylindrical member 130 is almost parallel to that of the ridge 111 and the groove 112 immediately before the end portion 140. This configuration notably reduces the pressure loss in the ink In this embodiment, the orientation of the cylindrical member 130 is almost perpendicular to the end face of the longitudinal direction of the base member 110. This configuration allows the liquid supplying member 100 to be connected to the recording head or the cartridges 145 in a manner similar to the case of the prior art polyethylene tubes.

Further, the mutual positions of a plurality of the cylindrical members 130 are fixed by couplers 132. The respective positions of a plurality of the cylindrical members 130 align with the position of the portion of the recording head or the cartridges 145 connected to the liquid supplying member 100. This configuration allows the liquid supplying member 100 to be easily attached to the recording head or the cartridges 145.

As shown in FIG. 18, the cylindrical member 130 is formed integrally (monolithically) With the base member 110. This configuration makes it unnecessary to attach the cylindrical member 130 to the liquid supplying member 100 when the liquid supplying member 100 is attached to the recording head or the cartridge 145.

More specifically, the base member 110, the cylindrical members 130, and the couplers 132 are formed integrally (monolithically) by injection molding with thermoplastic elastomer. This configuration allows the substrate and the cylindrical members 130 to be fabricated in a single process, and hence reduces the fabrication cost of the liquid supplying member 100.

Figure 19:
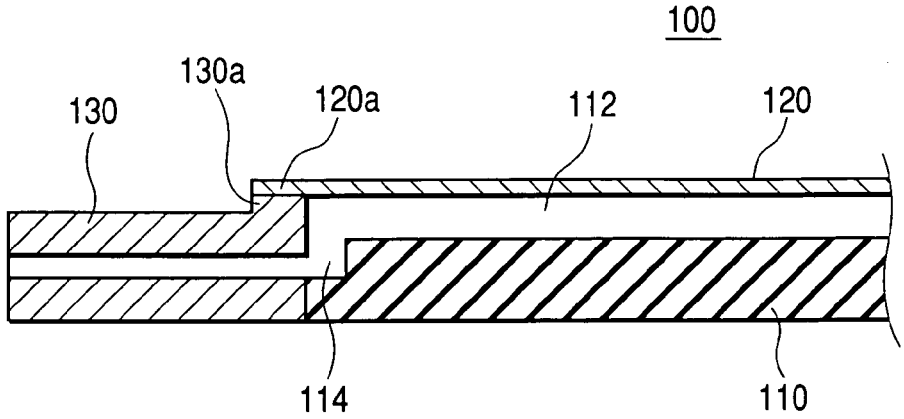
FIG. 19 is a longitudinal section view showing a modified example of the liquid supplying member of FIG. 13.

Incidentally, as shown in FIG. 19, the base member 110, the cylindrical members 130, and the couplers 132 may be formed by two-color (two-component) molding, while the cylindrical members 130 and the couplers 132 may be formed with a material harder than the base member 110. This configuration improves the durability of the liquid supplying member 100.

An end 120*a* of the elongated plate member 120 extends over the base-side end 130*a* of the cylindrical member 130, so as to be joined thereto. The shape of the cross section of the base-side end 130*a* is almost the same as that of the base member 110, and hence is almost rectangular. For the purpose of welding with the reinforcement layer 122, the base-side end 130*a* is formed thicker than the other portion of the cylindrical member 130.

The groove 112 is provided in the one face 110*a* of the base member 110, and hence could cause misalignment in the thickness direction relative to the ink passage of the cylindrical member 130 unless certain correction is made. Thus, for the purpose of connecting with the cylindrical member 130, the groove 112 has a recess 114 at an end on the cylindrical member 130 side. The recess 114 is formed such that its bottom face is flush with the inner bottom circumference face of the cylindrical member 130.

Figure 20:
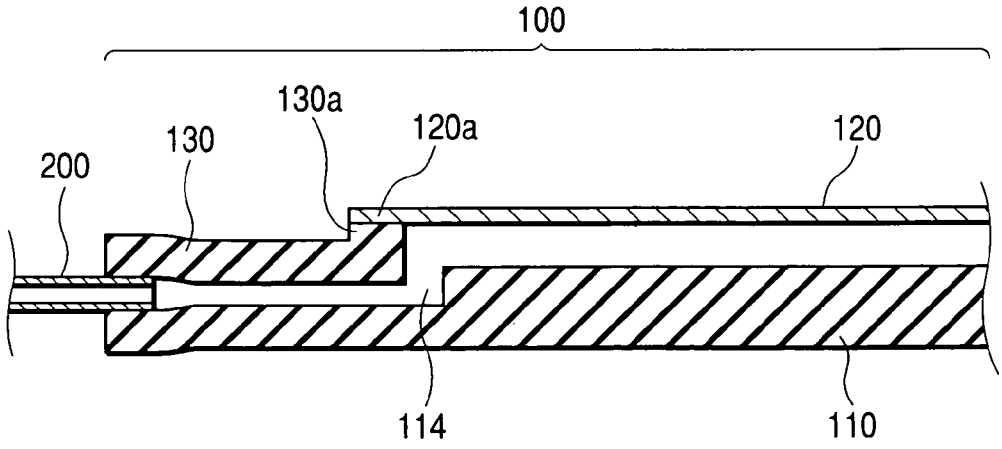
FIG. 20 is a longitudinal section view showing a condition that the liquid supplying member of FIG. 13 is connected to a device-side connector.

FIG. 20 shows a structure for connecting the liquid supplying member 100 to a device-side connector 200 provided in the recording head or the cartridge 145. The device-side connector 200 is a cylindrical member, and is formed with a material harder than the cylindrical member 130. The device-side connector 200 is inserted to the inside of the cylindrical member 130, so as to be connected to the liquid supplying member 100.

The configuration of the liquid supplying member 100 may be modified in accordance with the configuration of the device-side connector 200 as discussed below.

Figure 21:
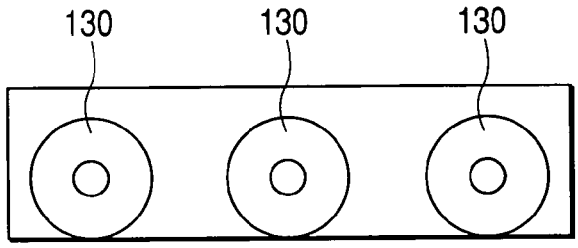
FIG. 21 is a front view showing a liquid supplying member according to a fifth embodiment of the invention.

FIG. 21 shows a liquid supplying member 100 according to a fifth embodiment of the invention. In this embodiment, no coupler 132 is provided for fixing the relative positions of the cylindrical members 130, and hence the cylindrical members 130 are provided in a manner not connected to each other. The other points of the configuration are the same as those of the liquid supplying member 100 of the fourth embodiment. This embodiment increases the degree of freedom in the arrangement of the cylindrical members 130.

Figure 22:
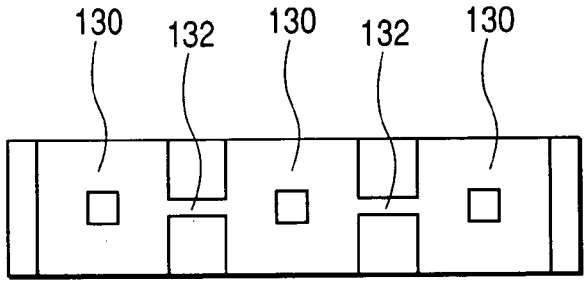
FIG. 22 is a front view showing a liquid supplying member according to a sixth embodiment of the invention.

FIG. 22 shows a liquid supplying member 100 according to a sixth embodiment of the invention. The configuration of this embodiment is the same as that of the liquid supplying member 100 of the fourth embodiment, except for the points that the outer shape of the cross section of the cylindrical member 130 is almost rectangular, and that the outer shape of the cross section of the ink passage is almost rectangular. The cylindrical member 130 is injection-molded together with the base member 110, and hence can have various shapes, as an example shown in this figure.

Figure 23:
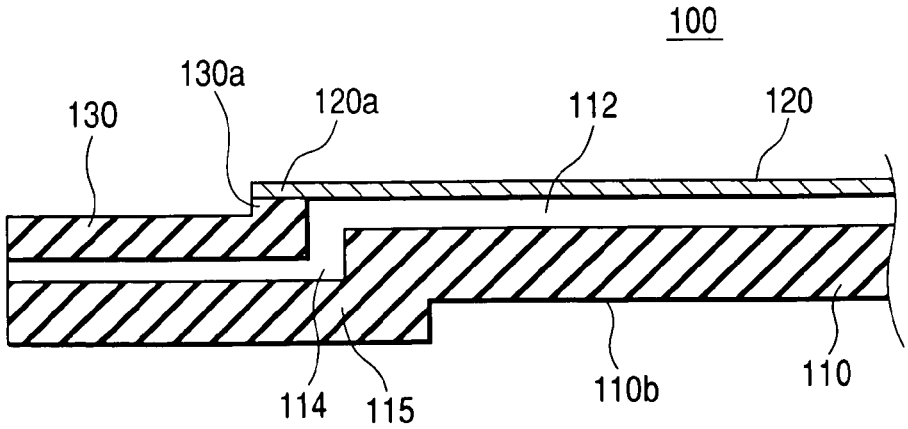
FIG. 23 is a front view showing a liquid supplying member according to a seventh embodiment of the invention.

FIG. 23 shows a liquid supplying member 100 according to a seventh embodiment of the invention. In this embodiment, in order to increase the thickness of the portion having the recess 114, the base member 110 has a protrusion 115 in a back face 110*b* opposite to the one face 110*a* at a position corresponding to the recess 114. The other points of the configuration are the same as those of the liquid supplying member 100 of the fourth embodiment. This configuration reduces the amount of the ink solvent and the outside air that permeates through the portion of the liquid supplying member 100 having the recess 114.

Further, in this embodiment, a portion on the back face 110*b* side of the cylindrical member 130 is inflated such that the outer circumference face is flush with the bottom face of the protrusion 115. This configuration reduces the amount of the ink solvent that permeates through the cylindrical member 130 and the amount of the outside air that permeates through the cylindrical member 130 and thereby dissolves into the ink.

Figure 24:
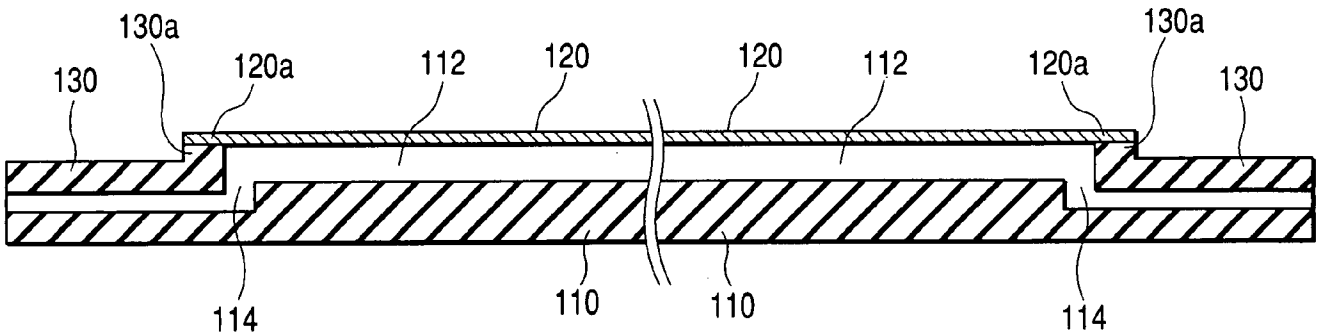
FIG. 24 is a front view showing a liquid supplying member according to an eighth embodiment of the invention.

FIG. 24 shows a liquid supplying member 100 according to an eighth embodiment of the invention In this embodiment, each of the two ends of the liquid supplying member 100 has a plurality of cylindrical members 130. The other points of the configuration are the same as those of the liquid supplying member 100 of the fourth embodiment, including the structure for connecting the base member 110 to the cylindrical members 130. As such, the cylindrical members 130 may be provided at both ends instead of only at one end. Here, since the cylindrical members 130 are arranged correspondingly to the configuration of the portion to which the cylindrical members 130 are to be connected, the arrangement of the cylindrical members 130 at one end can be different from that of the cylindrical members 130 at the other end.

Figure 25:
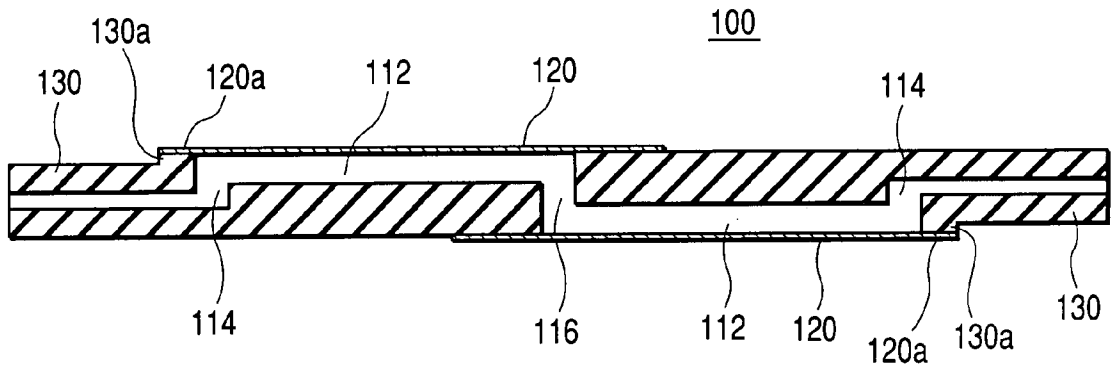
FIG. 25 is a front view showing a liquid supplying member according to a ninth embodiment of the invention.

FIG. 25 shows a liquid supplying member 100 according to a ninth embodiment of the invention. In this embodiment, the ridges 111 and the grooves 112 are formed in the one face 110*a* in a region ranging from one end of the longitudinal direction to a longitudinal intermediate portion, while the ridges 111 and the grooves 112 are formed in the back face 110*b* in a region ranging from the intermediate portion to the other end. Further, the portion in front of the other end has connection holes 116 each connecting two grooves 112. The intermediate portion may be arbitrarily determined.

According to this configuration, even when the liquid supplying member 100 is bent into an S-shape, the direction of the bend can be such that the base member 110 contracts throughout the length.

Figure 26:
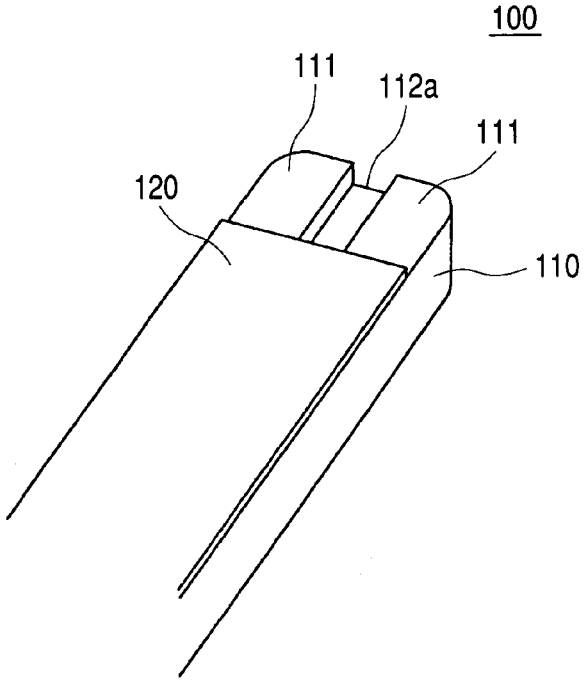
FIG. 26 is a perspective view showing a liquid supplying member according to a tenth embodiment of the invention.

FIG. 26 shows a liquid supplying member 100 according to a tenth embodiment of the invention. In this embodiment, the liquid supplying member 100 is not provided with the cylindrical member 130 Further, the elongated plate member 120 does not cover the upper face of the ridges 111 and the opening face of the groove 112 at an end portion of the longitudinal direction of the base member 110, so as to expose the groove end 112*a* of the groove 112. The end portion of the longitudinal direction of the base member 110 is used as a connecting section. In this example, only a single groove 112 is provided.

Figure 27:
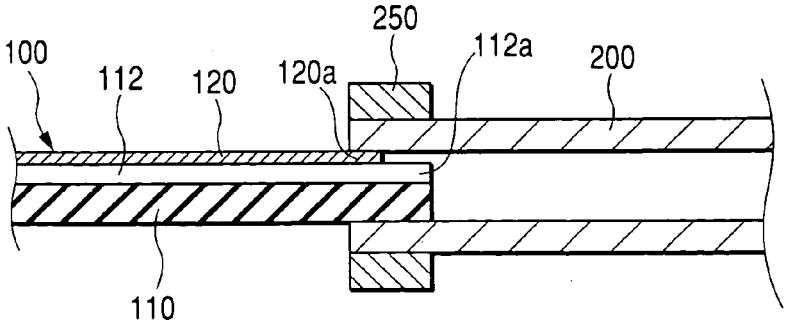
FIG. 27 is a longitudinal section view showing a condition that the liquid supplying member of FIG. 26 is connected to a device-side connector.

FIG. 27 shows a structure for connecting the liquid supplying member 100 of FIG. 26 to a device-side connector 200 provided at the recording head or the cartridge 145. The entirety of the groove end 112*a* and the end portion 120*a* of the elongated plate member 120 are inserted into the inside of the device-side connector 200, so that the liquid supplying member 100 is connected to the device-side connector 200. The end of the device-side connector 200 is pressed inward by a retainer ring 250, so that the liquid supplying member 100 is fixed to the connecting section of the device-side connector 200.

Even in this configuration, the groove 112 has an opening in the end face of the liquid supplying member 100. Thus, the liquid supplying member 100 can supply ink to the device-side connector 200. Further, the base member 110 can be injection-molded. This reduces the fabrication cost of the liquid supplying member 100. Furthermore, the number of components for constructing the liquid supplying member 100 is reduced, and hence the fabrication cost of the liquid supplying member 100 is reduced further.

In the configuration of FIG. 26, a plurality of grooves 112 may be provided. In this case, for example, the end portion of the longitudinal direction of the liquid supplying member 100 may be cut in the longitudinal direction in such a manner that the respective grooves 112 are separated from each other. Then, the separated portions may, respectively, be inserted into the device-side connectors 200.

As seen from the description provided above, the liquid supplying member 100 according to the invention can be arranged with less space. Further, during the carriage driving, the load is reduced on the motor for driving the carriage Furthermore, when the cylindrical member 130 is used for connecting the recording head or the cartridge 145, the liquid supplying member 100 can be used in a manner similar to the case of the conventional polyethylene tube.

In the above embodiments, the ink jet recording apparatus (printing apparatus including facsimile, copier and the like) for ejecting ink is exemplified as the liquid ejection apparatus. The liquid ejection apparatus may eject another kind of liquid, as a matter of course. Examples of such apparatus is a liquid ejection apparatus for jetting liquid, e.g., electrode material or colorant, used in manufacturing LCD devices, EL display devices, FET (field emission display) devices, a liquid ejection apparatus for ejecting organic material used in manufacturing biological biochips, and a test sample ejection apparatus as an accurate pipette.

The ejected object may be recording paper; a circuit board onto which a circuit pattern such as the electrodes of a display is printed; a CD-ROM onto which a label is printed; and a preparation onto which a DNA circuit is printed.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A liquid supplying member, adapted to supply liquid from a liquid container to a liquid ejection head which are provided in a liquid ejection apparatus, the liquid supplying member comprising:

a flexible base member, having a first face formed with at least one first groove;

a flexible first plate member, joined to the first face of the base member so as to seal at least a part of the at least one first groove so that the at least one first groove serves as at least one liquid supplying passage, through which the liquid is supplied from the liquid container to the liquid ejection head; and a first connector, monolithically formed with a first longitudinal end portion of the base member and adapted to communicate the at least one groove with one of the liquid container and the liquid ejection head.

2. The liquid supplying member as set forth in claim 1, wherein the first connector comprises at least one tubular member.

3. The liquid supplying member as set forth in claim 2, wherein the tubular member is protruded from an end face of the first longitudinal end portion.

4. The liquid supplying member as set forth in claim 2, wherein a plurality of first grooves and a plurality of tubular members are provided in a one-by-one manner.

5. The liquid supplying member as set forth in claim 4, wherein the first connector further comprises a coupler which connects adjacent ones of the tubular members to fix a relative position therebetween.

6. The liquid supplying member as set forth in claim 1, wherein the base member and the first connector are formed from an identical material.

7. The liquid supplying member as set forth in claim 1, wherein the base member is formed from a first material, and the first connector is formed from a second material which is harder than the first material.

8. The liquid supplying member as set forth in claim 6, wherein the base member and the first connector are formed from a thermoplastic elastomer.

9. The liquid supplying member as set forth in claim 1, wherein:

the first plate member is joined to the base member such that the at least one first groove is exposed at the first longitudinal end portion of the base member; and the first longitudinal end portion is directly connected to one of the liquid container and the liquid ejection head to serve as the first connector.

10. The liquid supplying member as set forth in claim 1, further comprising a second connector monolithically formed with a second longitudinal end portion of the base member to connect the at least one first groove to the other one of the liquid container and the liquid ejection head.

11. The liquid supplying member as set forth in claim 1, wherein:

the base member has a second face which is opposite to the first face and formed with at least one second groove which is communicated with the first groove at a longitudinal intermediate portion of the base member; and the liquid supplying member further comprises:

a flexible second plate member joined to the second face of the base member so as to seal at least a part of the at least one second groove; and a second connector monolithically formed with a second longitudinal end portion of the base member and adapted to communicate the at least one second groove with the other one of the liquid container and the liquid ejection head.

12. A method of manufacturing a liquid supplying member, adapted to supply liquid from a liquid container to a liquid ejection head which are provided in a liquid ejection apparatus, comprising steps of:

forming a first member comprising:

a flexible base member, having a first face formed with at least one first groove; and a first connector, monolithically formed with a first longitudinal end portion of the base member and communicated with the at least one first groove; and joining a flexible second member to the first face of the base member so as to seal at least a part of the at least one first groove so that the at least one first groove serves as at least one liquid supplying passage, through which the liquid is supplied from the liquid container to the liquid ejection head.

13. The manufacturing method as set forth in claim 12, wherein the first member is formed by an injection molding.

14. A liquid ejection apparatus, comprising:

a liquid ejection head, operable to eject liquid toward an object;

a liquid container, storing liquid to be ejected by the liquid ejection head; and a liquid supplying member, adapted to supply the liquid in the liquid container to the liquid ejection head, the liquid supplying member comprising:

a flexible base member, having a first face formed with at least one first groove;

a flexible first plate member, joined to the first face of the base member so as to seal at least a part of the at least one first groove so that the at least one first groove serves as at least one liquid supplying passage, through which the liquid is supplied from the liquid container to the liquid ejection head; and a first connector, monolithically formed with a first longitudinal end portion of the base member and adapted to communicate the at least one groove with one of the liquid container and the liquid ejection head.

15. A liquid supplying member, for supplying liquid from a liquid container to a liquid ejection head which are provided in a liquid ejection apparatus, the liquid supplying member comprising:

a flexible base member, having a first face formed with at least one first groove;

a flexible first plate member, joined to the first face of the base member so as to seal at least a part of the at least one first groove to form at least one liquid supplying passage, through which the liquid is supplied from the liquid container to the liquid ejection head; and a first connector, monolithically formed with a first longitudinal end portion of the base member to connect the at least one groove to one of the liquid container and the liquid ejection head, wherein:

the base member has a second face which is opposite to the first face and formed with at least one second groove which is communicated with the first groove at a longitudinal intermediate portion of the base member; and the liquid supplying member further comprises:

a flexible second plate member joined to the second face of the base member so as to seal at least a part of the at least one second groove; and a second connector monolithically formed with a second longitudinal end portion of the base member to connect the at least one second groove to the other one of the liquid container and the liquid ejection head.

* * * * *